US005809590A

United States Patent [19]

Williams et al.

[11] Patent Number: 5,809,590

[45] Date of Patent: Sep. 22, 1998

[54] THERMOCHROMIC URINAL MAT

[76] Inventors: Theodore A. Williams, 17560 Kendel Ct., Hastings, Minn. 55033; Richard C. Meyers, 408 Hennessy Ct., Gilberts, Ill. 60136

[21] Appl. No.: 758,549

[22] Filed: Nov. 29, 1996

[51] Int. Cl.[6] ..... A47K 17/00

[52] U.S. Cl. ..... 4/661; 4/300.3

[58] Field of Search ..... 4/661, 300.3, 222.1, 4/222; 374/162; 503/201, 215, 226

[56] References Cited

U.S. PATENT DOCUMENTS

| | | | |
|---|---|---|---|
| D. 258,472 | 3/1981 | Adam | 4/661 |
| 4,744,113 | 5/1988 | Kogut | 4/661 |
| 5,219,625 | 6/1993 | Matsunami et al. | 428/30 |
| 5,223,958 | 6/1993 | Berry | 359/43 |
| 5,363,516 | 11/1994 | Butts | 4/483 |

*Primary Examiner*—David J. Walczak
*Attorney, Agent, or Firm*—D. L. Tschida

[57] ABSTRACT

A waterproof urinal mat which contains humorous or informational messages printed or coated over with thermochromic inks. The mat is formed to fit in a urinal, such that included text and artwork printed onto the mat with temperature sensitive, thermochromic inks display multiple images at an ambient temperature and upon being contacted with urine or flush water. In alternative arrangements, thermochromic inks of selected activation temperatures are variously printed onto the substrate in relation to an opaque image before coating the substrate with a waterproof covering or laminate. Two or more images are thereby visible upon contacting the mat with urine and flush water. Apertures and protrusions at the mat prevent splashing and direct liquid flow relative to the images.

14 Claims, 4 Drawing Sheets

THERMOCHROMIC URINAL MAT

BACKGROUND OF THE INVENTION

The present invention relates to a urinal mat which contains printed entertainment or advertising messages and, in particular, to a mat which is printed with thermochromic inks to selectively display text and artwork during urination and flushing.

A variety of urinal mats and appliances are known for controlling splashing at urinals. Such devices may include perforations, baffles or other mechanisms to prevent splashing. Some examples of these devices are shown at U.S. Pat. Nos. 5,313,672 and 5,027,448.

A novelty, urinal target is shown at U.S. Pat. No. 4,044,405.

Thermochromic paints and inks have also been incorporated into a variety of items to indicate temperature or expose other relevant indicia at an activation temperature. For example, U.S. Pat. Nos. 5,202,677 and 5,156,283 reveal a temperature controlled advertising or information display and a beer stein emblem. U.S. Pat. No. 5,282,651 discloses trading cards having interactive regions which are selectively exposed upon rubbing with the hand. U.S. Pat. No. 5,389,093 discloses a baby diaper having an insulated layer which upon becoming wet induces a change in printed indicia at the exposed surface of the diaper. Thermally sensitive fishing lures are disclosed at U.S. Pat. No. 5,222,320.

Applicant, however, is not aware of any urinal mats or other thermochromic coated device which upon contact with one or more liquids, such as during urination and flushing, selectively exposes one or more indicia containing messages and/or artwork.

SUMMARY OF THE INVENTION

It is a primary object of the invention to provide a mat which includes temperature sensitive inks that upon being subjected to a liquid at an activation temperature selectively exposes an image for viewing.

It is a further object of the invention to provide a urinal mat which contains a printed opaque image having regions which contain informational or humorous text and/or artwork, such that first and second images are selectively exposed before and during urination.

It is a further object of the invention to apply thermochromic and opaque inks in a silk screen, rotary letterpress, flexographic or sheet fed offset process in juxtaposition or overlying registry to one another.

It is a further object of the invention to apply multiple thermochromic inks having selected ambient and activation temperature sensitivities relative to the printed image, whereby multiple images are displayed upon exposure to liquids at differing temperatures.

Various of the foregoing objects, advantages and distinctions of the invention are obtained in a presently preferred urinal mat construction which provides an opaque printed image that includes text and artwork. The image is applied to a cut substrate and over which one or more thermochromic inks and waterproofing layers or materials are sequentially applied. The mat can be formed to prevent or minimize splashing or control liquid flow to facilitate the exposure of the printed images. At an ambient temperature, the entire or portions of the printed image are made selectively visible or invisible. A secondary image is particularly made visible upon urine striking and washing over the mat.

Alternative constructions of the invention are also shown wherein thermochromic inks of differing thermal characteristics are applied in juxtaposition and/or overlying registry to one another and to an opaque printed image. The exposure of multiple images is thereby possible with contact by liquids of differing temperatures. The images can comprise text and artwork and, for example, may display messages, advertising, or a game board.

Still other objects, advantages and distinctions of the invention will become more apparent upon reference to the following description with respect to the appended drawings. The description should not be literally construed in limitation of the invention, which instead should be interpreted to include all equivalent constructions within the scope of the further appended claims.

DESCRIPTION OF THE PREFERRED EMBODIMENT

Figure 1:
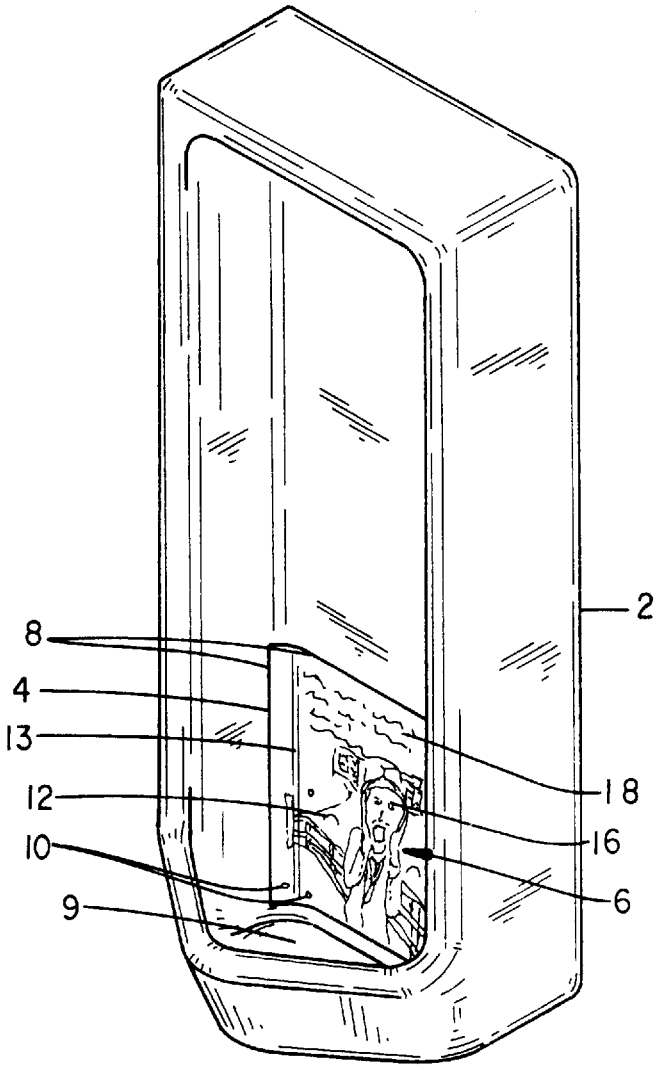
FIG. 1 is a perspective drawing to a urinal fitted with a urinal mat which contains a printed image that is selectively coated with a thermochromic ink.
Figure 2:
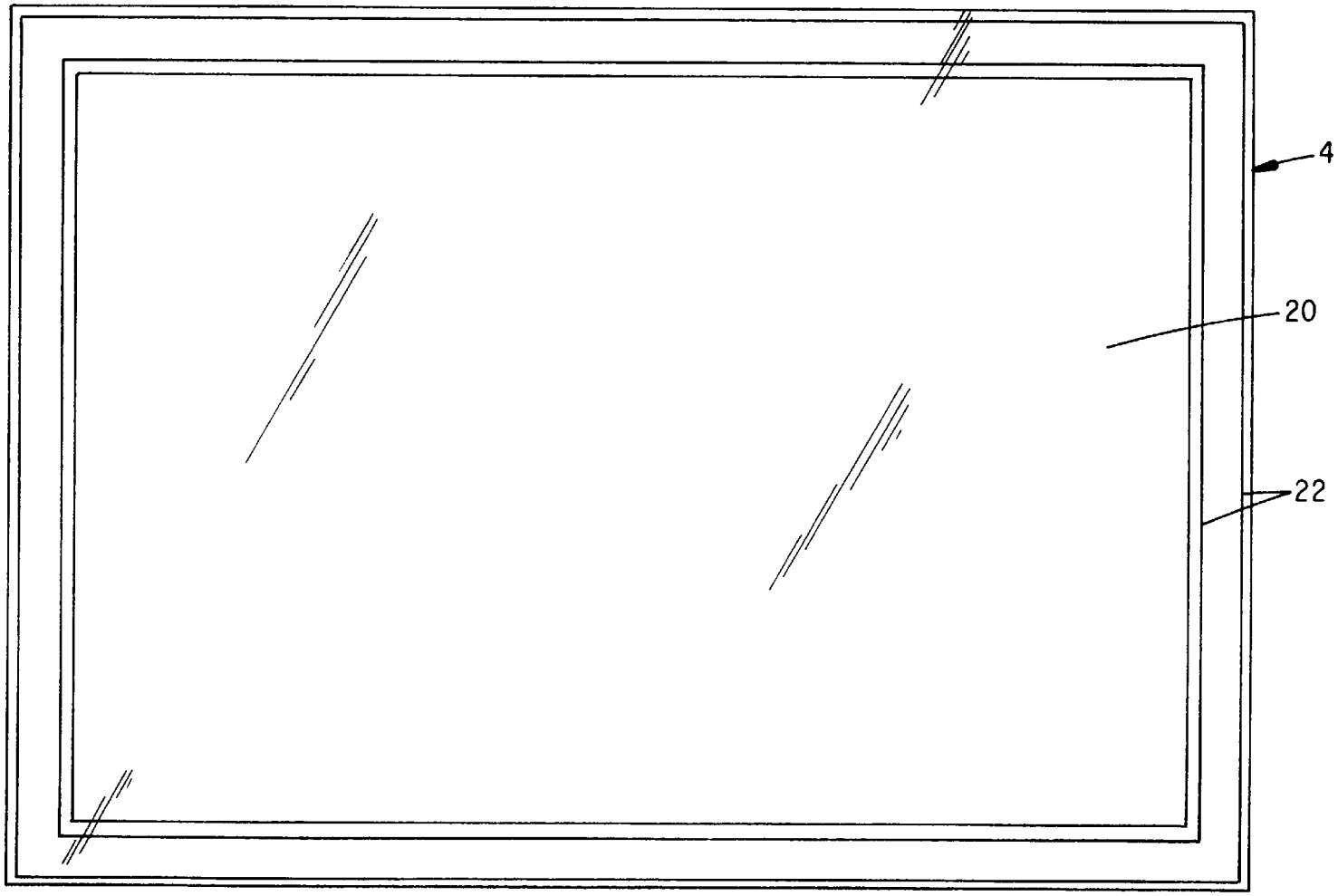
FIG. 2 is a plan view of a urinal mat as it appears at ambient room temperature.
Figure 3:
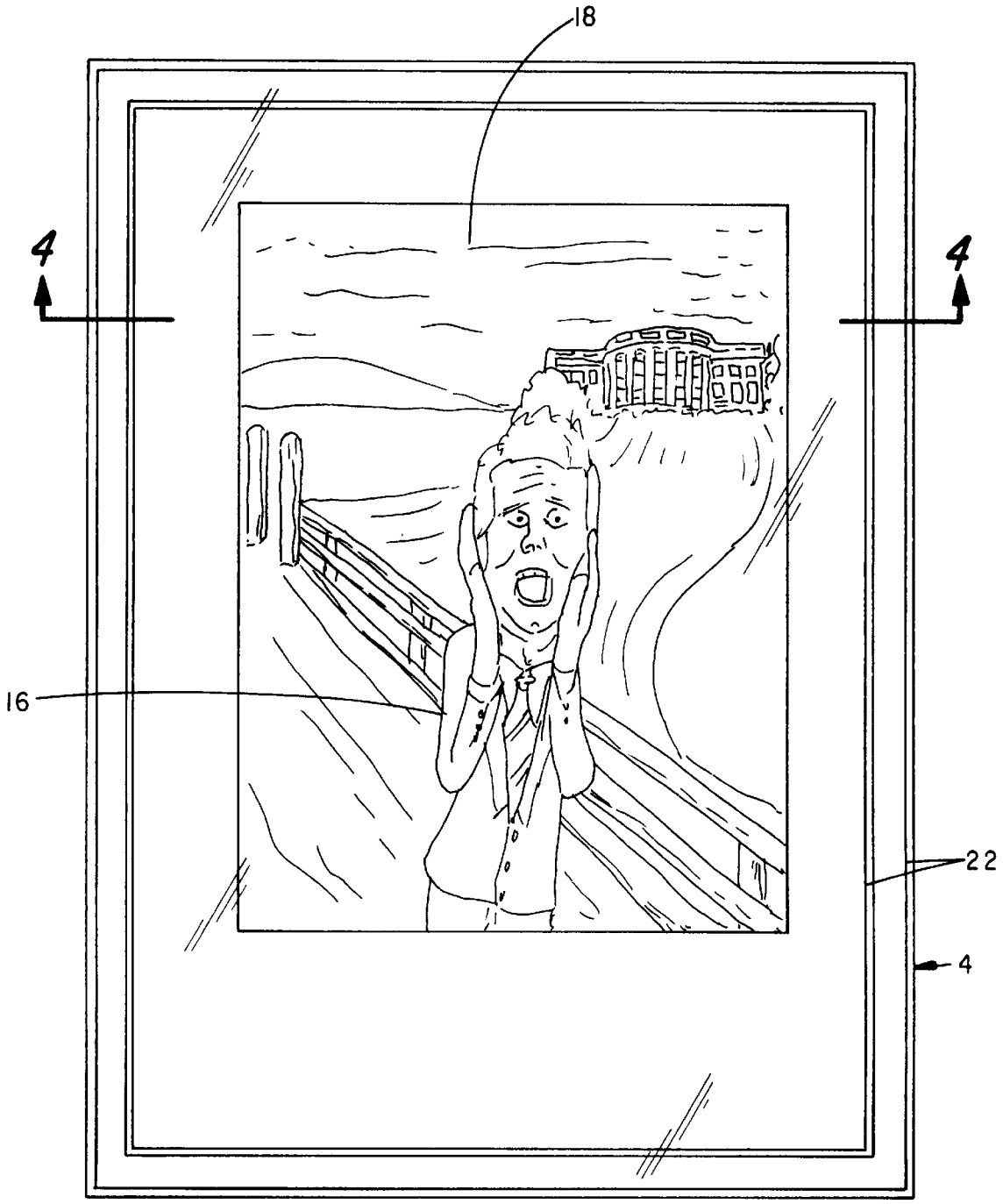
FIG. 3 is a plan view of the mat of FIG. 2 after an opaque cover layer turns transparent during urination to expose a lower lying printed image.

Referring to FIG. 1, a perspective drawing is shown to a urinal 2 that is fitted with a urinal mat 4. The mat 4 is shown as it might appear after the urinal 2 has been used and the mat 4 has been exposed to urine. A complete printed image 6, reference FIG. 2, is then typically exposed, due to the activation of thermochromic inks at the mat 4 with urine. The temperature of the urine being greater than the activation temperature of thermochromic inks used at the mat 4. Less than the entire image 6 might be exposed, if the urine is not directed to wash the entire surface of the mat 4 or if multiple inks having different activation temperatures are applied to the mat. The duration of the image exposure and the activation temperature of the image 6 will depend upon the nature and composition of the thermochromic inks that are used.

Edges 8 of the mat 4 are cut or formed to allow the mat 4 to fit a urine receiving drain cavity 9 of the urinal 2. The mat 4 can be formed to include a number of apertures 10 or protrusions 12 to minimize splashing of urine. The apertures 10 and protrusions 12 can also be shaped and positioned to control the washing and flow of liquids over the mat 4 and/or shield selected regions relative to the possible images and thereby control the exposure of the images. The latter flexibility is desirable if, for example, an interactive game board is printed at the mat 4. Scribe lines 13 might also be included to facilitate folding and fitting the mat 4 to the urinal. The physical structure of the mat 4 is also constructed to be compatible with a preferred printing process. Various of the substrate forming steps can be performed after printing.

The mat 4 is presently constructed of a waterproof or water resistant substrate material 14 that is compatible with conventional opaque printing inks and a selected printing process. The opaque image 6 includes regions that display artwork 16 and text 18. The text 18 is shown in indistinct form but can consist of any desired message. The image 6 is printed with conventional opaque printing inks.

A variety of humorous and informational messages can be included at the printed image 6. For example, advertising messages or humorous artwork might be included. Game boards or other interactive images, which require selective washing of the mat 4, might also be provided. Judicious placement and arrangements of the apertures 10 and protrusions 12 can control the washing of the mat 4 and thereby the exposure of the possible images.

Figure 4:
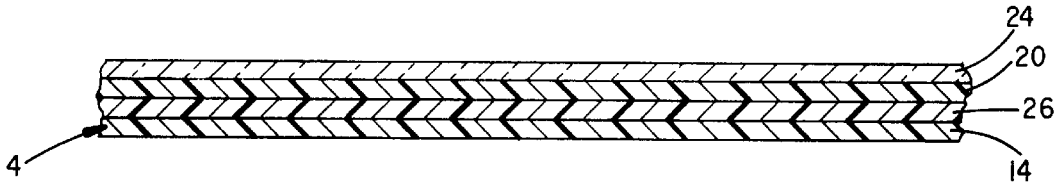
FIG. 4 is a cross section view through the mat of FIG. 3.

A cover layer 20 of a conventional thermochromic ink, reference FIGS. 2 and 4, is applied to the mat 4 to cover the entire image 6, except a border 22. Thermochromic printing inks are presently available from a number of different manufacturers and can be used in a variety of conventional printing processes.

The opaque inks used at the artwork and text 16, 18 are selected to be compatible with the thermochromic ink used at the cover layer 20. The inks are applied using a number of conventional printing processes, for example, silk screening, flexographic, rotary letterpress, sheet fed offset or gravure. A silk screen process is a preferred process.

With attention to FIG. 4, a waterproof substrate 14 is first prepared. During the printing process, one or more opaque regions 26 are applied to the substrate 14 using conventional printing inks to create the image 6. A thermochromic ink compatible with the anticipated ambient temperature and having a desired activation temperature is next applied to form a layer 20 which covers the image 6. The border 22 is permitted to remain exposed. A transparent, waterproof coating, such as a liquid resin, or a laminated sheet material is then applied to form a liquid resistant layer 24 to seal the inks 26 and 20 to the substrate 14 and create a durable, waterproof mat 4. Suitable forming steps are performed to cut the mat to size, punch the apertures 10 and/or form the protrusions 12.

Figure 6:
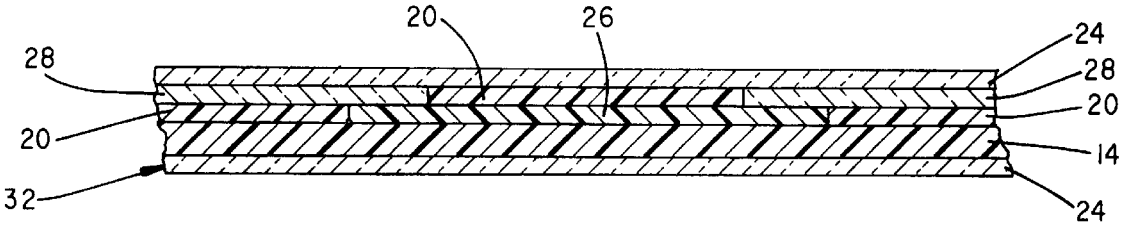
FIG. 6 is a cross section view through a third mat wherein thermochromic inks having different thermal activation temperatures are juxtaposed and layered over each other and an opaque primary image.

In lieu of a waterproof substrate 14, a variety of clear plastic sheet materials might be bound to both the top and bottom surfaces of a paper or cardboard substrate 14 to seal the image 6, reference FIG. 6.

Figure 5:
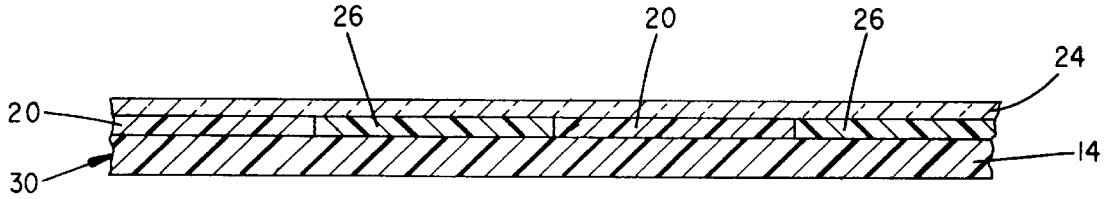
FIG. 5 is a cross section view through a second mat wherein regions which receive thermochromic and opaque inks are aligned in a single plane.

FIG. 5 depicts a cross section view through an alternative construction of a mat 30 wherein thermochromic regions 20, which change between transparent and opaque conditions, are printed in adjacent registry to the opaque regions 26 of the image 6. Upon thermal activation, the thermochromic regions 20 add to the image 6. One image is thus visible at the ambient temperature and another upon being washed with a liquid.

FIG. 6 depicts a cross section view through another alternative construction of a mat 32 wherein two thermochromic regions 20 and 28, which are printed with inks having different activation temperatures, are applied in registry to the normally opaque regions 26. In this instance, the urine might first activate the regions 20 relative to the opaque regions 26 to create one image. The flush water, in turn, might activate the thermochromic regions 28 and create a second image. Multiple images are thereby obtained to create a time dependent image. For example, the mat 32 might display a man with a sour faced expression at the ambient, a smiling expression of relief upon being contacted with urine and a "have a nice day" message upon being contacted with flush water.

It is also to be appreciated that different portions of the regions which contain the thermochromic inks 20 and 28 might change from opaque to transparent as other portions change from transparent to opaque. Thermochromic inks which merely change colors at different activation temperatures might also be applied to vary the effect of the displayed images.

While the invention has been described with respect to a number of presently considered constructions of urinal mats, still other constructions might be suggested to those skilled in the art. It is also to be appreciated the invention might be applied to mats that are fitted in different appliances or environments that are selectively exposed to any variety of liquids. The invention should therefore be construed to include all those constructions within the spirit and scope of the following claims.

What is claimed is:

1. A urinal mat comprising a substrate formed to mount within a urinal and having an opaque primary indicia printed thereon, wherein at least a portion of the primary indicia is visible and intelligible at an ambient temperature, wherein a first thermochromic composition is selectively applied in association to said primary indicia, wherein said first thermochromic composition is opaque at the ambient temperature and changes to transparent at a first activation temperature, and means for waterproofing the coated substrate, whereby the entire primary indicia becomes visible upon contacting the mat with a liquid having a temperature equal to said first activation temperature.

2. A urinal mat as set forth in claim 1 wherein said substrate includes means for preventing splashing and directing the flow of liquid contacting said mat in relation to the primary indicia.

3. A urinal mat as set forth in claim 2 wherein the mat includes a plurality of apertures.

4. A urinal mat as set forth in claim 2 wherein the first activation temperature is selected to match the temperature of urine, whereby the primary indicia becomes progressively visible upon washing the mat with urine.

5. A urinal mat as set forth in claim 1 wherein the activation temperature of the first thermochromic composition is selected to match the temperature of urine, wherein a second thermochromic composition, which is opaque at the ambient and first activation temperatures and changes to transparent at a second activation temperature different from the first activation temperature, is applied in association to said primary indicia and said first thermochromic composition, such that at least a portion of the primary indicia is visible at the ambient temperature, a second intelligible image is visible upon contact with urine at the first activation temperature and a third intelligible image is visible upon contact with a flush liquid at the second activation temperature.

6. A urinal mat as set forth in claim 5 wherein the opaque primary indicia and second thermochromic composition are applied in registry to each other to collectively form the second intelligible image.

7. A urinal mat as set forth in claim 1 including a plurality of apertures and protrusions which direct the washing of urine over the mat relative to the primary indicia and regions covered with said first thermochromic composition, whereby the primary indicia is interactively and selectively exposed during urination.

8. A urinal mat as set forth in claim 7 wherein a second thermochromic composition, which is opaque at the ambient and activation temperatures and changes to transparent at a second activation temperature different from the activation temperature, is applied in association to said primary indicia, such that at least a portion of the primary indicia is visible at the ambient temperature, a second intelligible image is visible upon contact with urine at the first activation temperature and a third image is visible upon contact with a flush liquid at the second activation temperature.

9. A urinal mat comprising a substrate having an opaque primary indicia printed thereon, wherein at least a portion of the primary indicia is visible and intelligible at an ambient temperature, wherein a first thermochromic composition is selectively applied in association to said primary indicia, wherein said first thermochromic composition is opaque at the ambient temperature and chances to transparent at a first activation temperature matching urine, means for preventing splashing at said mat, and means for waterproofing the coated substrate, whereby at least a portion of the primary indicia is visible at the ambient temperature and the entire primary indicia becomes visible upon contacting the mat with urine.

10. A urinal mat as set forth in claim 9 wherein a second thermochromic composition, which is opaque at the ambient and first activation temperatures and chances to transparent at a second activation temperature different from the activation temperature, is applied in association to said primary indicia, such that at least a portion of the primary indicia is visible at the ambient temperature, a second intelligible image is visible upon contact with urine at the first activation temperature and a third intelligible image is visible upon contact with a flush liquid at the second activation temperature.

11. A urinal mat as set forth in claim 9 including means for directing the washing of urine over the urinal mat relative to the primary indicia and said first thermochromic composition, whereby the primary indicia becomes progressively visible upon washing the urinal mat with urine.

12. A method for displaying a printed image comprising:

a) mounting in a urinal a mat containing an opaque primary indicia and in association to which primary indicia a first thermochromic composition is applied, which first thermochromic composition reverts from an opaque condition at an ambient temperature to a transparent condition at a first activation temperature, and wherein at least a portion of the primary indicia is visible and intelligible at the ambient temperature; and b) contacting the mat with urine at the first activation temperature to selectively expose the primary indicia, whereby the entire primary indicia can be selectively made visible during urination.

13. A method as set forth in claim 12 wherein said mat is coated with a second thermochromic composition having a second activation temperature different from the ambient and first activation temperatures and including the step of contacting the mat with a flushing liquid at the second activation temperature to selectively expose a third intelligible image.

14. A urinal mat as set forth in claim 1 wherein said substrate includes scribe lines for fitting the mat to the urinal.

* * * * *